US010927608B2

(12) United States Patent
Omidvar et al.

(10) Patent No.: US 10,927,608 B2
(45) Date of Patent: Feb. 23, 2021

(54) BI-CENTER BIT AND DRILLING TOOLS WITH ENHANCED HYDRAULICS

(71) Applicant: National Oilwell Vareo, L.P., Houston, TX (US)

(72) Inventors: Navid Omidvar, The Woodlands, TX (US); Roger H. Silva, Spring, TX (US); Nathan Taylor, Magnolia, TX (US)

(73) Assignee: National Oilwell Varco, L.P., Houston, TX (US)

( * ) Notice: Subject to any disclaimer, the term of this patent is extended or adjusted under 35 U.S.C. 154(b) by 28 days.

(21) Appl. No.: 15/892,913

(22) Filed: Feb. 9, 2018

(65) Prior Publication Data

US 2018/0230753 A1 Aug. 16, 2018

Related U.S. Application Data

(60) Provisional application No. 62/459,359, filed on Feb. 15, 2017.

(51) Int. Cl.
*E21B 10/30* (2006.01)
*E21B 10/50* (2006.01)

(52) U.S. Cl.
CPC ..... *E21B 10/30* (2013.01); *E21B 10/50* (2013.01)

(58) Field of Classification Search
CPC ..... E21B 10/26; E21B 10/30
See application file for complete search history.

(56) References Cited

U.S. PATENT DOCUMENTS 4,245,708 A * 1/1981 Cholet ..... E21B 10/18 175/325.2
4,618,010 A * 10/1986 Falgout, Sr. ..... E21B 10/26 175/385
6,298,929 B1 10/2001 Cobos Rojas
(Continued)

FOREIGN PATENT DOCUMENTS

EP 1085167 A2 3/2001
GB 2373522 A 9/2002

OTHER PUBLICATIONS

PCT/US2018/017589 International Search Report and Written Opinion dated May 4, 2018 (4 p.) (3314-42702).

*Primary Examiner* — David J Bagnell
*Assistant Examiner* — Dany E Akakpo
(74) *Attorney, Agent, or Firm* — Conley Rose, P.C.

(57) ABSTRACT

A drilling tool includes a pilot bit coupled to an eccentric reamer that has a reaming side and a stabilizing side. A fluid passageway extends between the reamer and the pilot bit, and the tool includes at least one upwardly-directed nozzle in fluid communication with the fluid passageway and positioned on the stabilizing side of the reamer. The reamer may include a plurality of angularly spaced blades on the reaming side that radially extend a first distance, the reamer blades being disposed within a first arcuate segment defined by the two most distant reamer blades. One or more stabilizing blades extend a second distance that is less than the first distance, the stabilization blades being disposed within a second arcuate segment defined by the two most distant reamer blades and that has the angular measure equal to 360 degrees minus the first arcuate segment.

23 Claims, 11 Drawing Sheets

(56) References Cited

U.S. PATENT DOCUMENTS

| | | | | |
|---|---|---|---|---|
| 6,340,064 | B2 * | 1/2002 | Fielder | E21B 10/43 175/385 |
| 2002/0166703 | A1 * | 11/2002 | Presley | E21B 10/16 175/391 |
| 2004/0238225 | A1 * | 12/2004 | Larsen | E21B 10/18 175/340 |
| 2012/0175106 | A1 | 7/2012 | Rankin | |

* cited by examiner

BI-CENTER BIT AND DRILLING TOOLS WITH ENHANCED HYDRAULICS

CROSS-REFERENCE TO RELATED APPLICATIONS

This application claims benefit of U.S. provisional patent application Ser. No. 62/459,359 filed Feb. 15, 2017, and entitled "Bi-Center Bit and Drilling Tools with Enhanced Hydraulics," which is hereby incorporated herein by reference in its entirety for all purposes.

STATEMENT REGARDING FEDERALLY SPONSORED RESEARCH OR DEVELOPMENT

Not applicable.

BACKGROUND

Field of the Invention

The present invention relates generally to downhole drilling operations. More particularly, the invention relates to tools for drilling boreholes. Still more particularly, the invention relates to bi-center bits and eccentric reamers for enlarging boreholes during drilling.

Background of the Technology

An earth-boring drill bit is connected to the lower end of a drill string and is rotated by rotating the drill string from the surface, with a downhole motor, or by both means. With weight-on-bit (WOB) applied, the rotating drill bit engages the formation and proceeds to form a borehole along a predetermined path toward a target zone.

In drilling operations, costs are generally proportional to the length of time it takes to drill a quality borehole to the desired depth and location. The time required to drill the well, in turn, is greatly affected by the number of times downhole tools must be changed or added to the drill string in order to complete the borehole. This is the case because each time a tool is changed or added, the entire string of drill pipes, which may be miles long, must be retrieved from the borehole, section-by-section. Once the drill string has been retrieved and the tool changed or added, the drill string must be re-constructed section-by-section and lowered back into the borehole. This process, known as a "trip" of the drill string, requires considerable time, effort and expense. Because drilling costs are typically on the order of thousands of dollars per hour, it is desirable to reduce the number of times the drill string must be tripped.

While drilling, achieving good borehole quality is also desirable. However, achieving the desired quality when drilling long horizontal boreholes can be particularly challenging. In particular, to keep the borehole path as close as possible to horizontal, the driller may have to periodically change the direction of the borehole path because gravity has a tendency to cause the drill bit drop slightly below horizontal. For this reason and others, the driller must make corrections to put the drill bit back on the desired trajectory using a directional motor or rotary steerable assembly. Unfortunately, repeated corrections can result in the formation of ledges and/or sharp corners in the borehole that interfere with the passage of subsequent tools therethrough.

A reamer can be used to remove ledges and sharp corners in the borehole. For a non-expanding reamer, the size of the reamer is limited by the diameter of the casing in the borehole that the drill bit and reamer must pass through. If a concentric non-expanding reamer having the same or smaller diameter than the drill bit is used with the drill bit, the reamer will generally follow the path of the drill bit and may not be totally effective in removing the ledges and/or sharp corners. An eccentric reamer reams the borehole to a diameter that is larger than the diameter of the drill bit and is typically effective in removing ledges and sharp corners. Most conventional eccentric reamers have a plurality of circumferentially-spaced blades lined with cutter elements that engage and shear the borehole sidewall. The blades are non-uniformly distributed about the tool, and thus, they occupy less than the total circumference of the tool, thereby making the reamer eccentric.

While necessary for reaming purposes, the addition of reamer blades above the drill bit may have the effect of disrupting the hydraulics that are desirable for removing the drilled cuttings and efficiently conveying them to the surface. Disruptions to the preferred hydraulics caused by the size, number and placement of the reamer blades may have the detrimental effect of slowing removal of the drilled cuttings. Poor hydraulics may lead to "bit balling," a phenomenon where drilled cuttings become compacted on bit features, such as on the cutter elements, or on bit blades. In turn, this can lead to a decreased rate of penetration and may require tripping the drill string prematurely, each of which can add significantly to the total cost of drilling the well.

Accordingly, there remains a need in the art for improved eccentric reamers for smoothing the profile of a borehole during drilling operations. Such reamers would be particularly well-received if they were provided with features so as to increase the speed of the evacuation of the drilled cuttings and decrease the chance of bit balling.

BRIEF SUMMARY OF THE DISCLOSURE

These and other needs in the art are addressed in varying degrees by embodiments of drilling tools that are disclosed herein. In an embodiment, a drilling tool includes a pilot bit portion coupled to an eccentric reamer, and a fluid passageway extending between the reamer and the pilot bit. The reamer includes a reaming side and a stabilizing side. At least one upwardly-directed fluid nozzle is positioned on the stabilizing side of the reamer. In one embodiment, the fluid nozzle is configured to direct fluid upwardly away from the pilot bit and at an acute angle with respect to the axis of the tool.

In another embodiment, a drilling tool includes a body having a central longitudinal axis and a fluid passageway therethrough. A pilot bit is disposed at a first end of the body and has a rotational axis aligned with the central axis of the body. A reamer portion is included on the body and is axially spaced apart from the pilot bit. The reamer portion comprises an outer surface, and a plurality of reamer blades angularly spaced apart and extending away from the outer surface a first distance measured radially from the central axis, the reamer blades being disposed within a first arcuate segment that is defined by the two most distant reaming blades. The reamer portion further includes one or more stabilization blades extending away from the outer surface a second distance measured radially from the central axis, wherein the second distance is less than the first distance, the one or more stabilization blades being disposed within a second arcuate segment that is defined by the two most distant reamer blades and that has the angular measure equal to 360 degrees minus the measure of the first arcuate segment. A nozzle is disposed in the second arcuate segment and is configured so as to direct fluid that is conveyed to the nozzle from the fluid passageway away from the pilot bit and in a direction that forms an acute angle as measured with respect to the central axis.

In still another embodiment, a drilling tool comprises a pilot bit that is concentric to a central axis and is coupled to an eccentric reamer, the reamer including a reaming side with reamer blades and a stabilizing side with at least one stabilizer blade. A fluid passageway extends through the eccentric reamer, and at least one nozzle in the reamer is configured to direct fluid that is conveyed to the nozzle from the fluid passageway away from the pilot bit and in a direction that forms an acute angle as measured with respect to the central axis. The tool includes a buttress on the reamer configured to increase the wall thickness of the reamer at the position of the nozzle. The buttress may include a ramp surface that extends away from the body of the tool at a ramp angle configured so as to direct the fluid flow in a predetermined direction.

In some embodiments, a drilling tool includes a neck portion between a pilot bit and an eccentric reamer, wherein the neck portion includes a frustoconical outer surface that tapers from a first diameter adjacent the pilot bit to a second diameter adjacent the reamer, wherein the second diameter is greater than the first diameter.

Embodiments described herein comprise components, features and combinations thereof intended to address various shortcomings associated with certain prior devices, systems, and methods. The foregoing has outlined rather broadly the components and features of the disclosed embodiments in order that the detailed description that follows may be better understood. The various characteristics, components, devices and methods described above, as well as others, will be readily apparent to those skilled in the art upon reading the following detailed description, and by referring to the accompanying drawings.

BRIEF DESCRIPTION OF THE DRAWINGS

For a detailed description of the disclosed exemplary embodiments, reference will now be made to the accompanying drawings in which.

DETAILED DESCRIPTION OF THE DISCLOSED EXEMPLARY EMBODIMENTS

Figure 1:
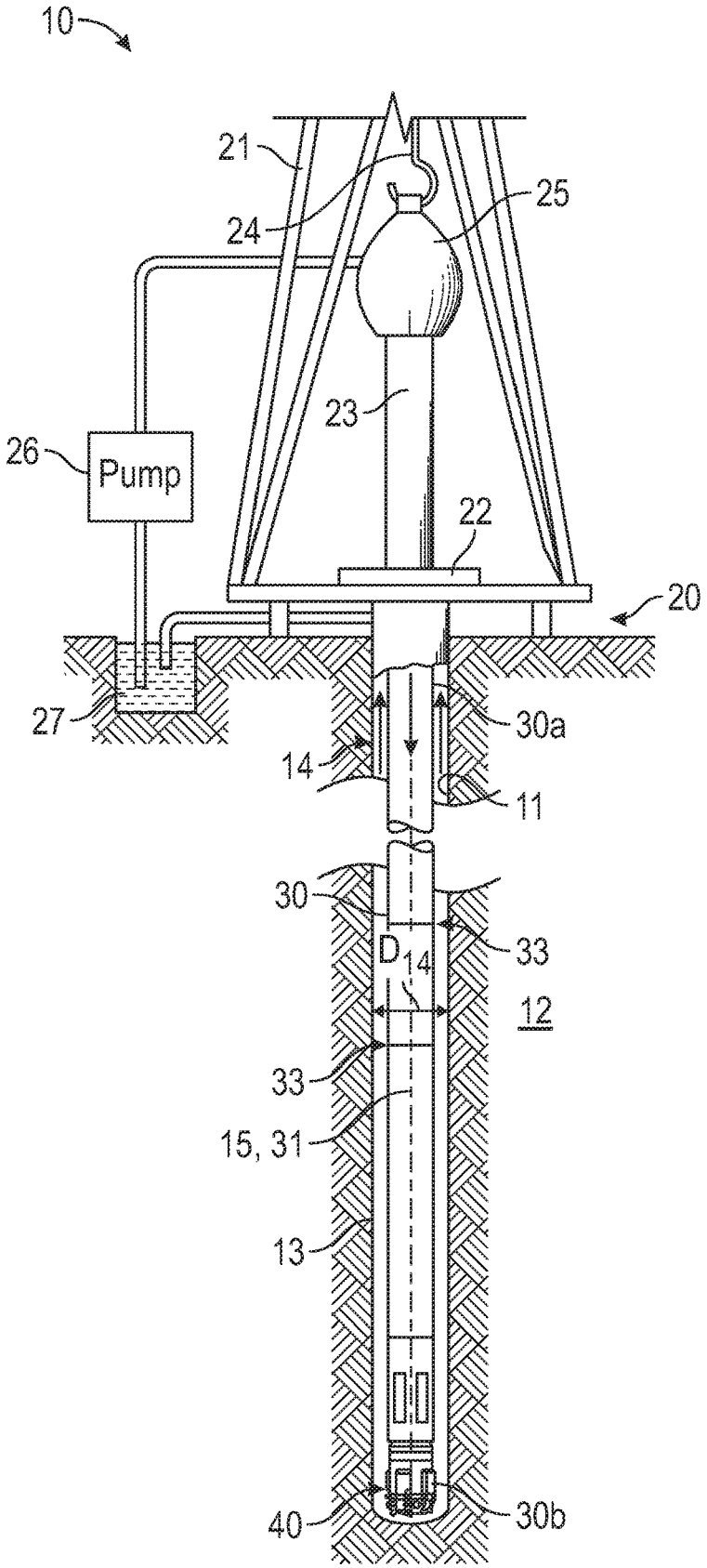
FIG. 1 is a schematic view of an embodiment of a drilling system having a downhole drilling tool in accordance with principles described herein.

The following discussion is directed to various exemplary embodiments. However, the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other intermediate devices, components, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring now to FIG. 1, an embodiment of a drilling system 10 includes a drilling rig 20 positioned over a borehole 11 that extends into a subsurface formation 12, a casing 14 extending from the surface into the upper portion of borehole 11, and a drill string 30 suspended in borehole 11 from a derrick 21 of rig 20. Casing 14 has a central or longitudinal axis 15 and an inner diameter $D_{14}$. Drill string 30 has a central or longitudinal axis 31, an uphole end 30*a* coupled to derrick 21, and a downhole end 30*b* opposite end 30*a*. In addition, drill string 30 includes drilling tool 40, which in this embodiment is a bi-center drill bit, at downhole end 30*b*, and a plurality of pipe joints 33 extending from uphole end 30*a* to bit 40. Pipe joints 33 are connected end-to-end, and bit 40 is connected to the lowermost pipe joint 33. Drill string 30 may include other tools and components, not shown, but that are axially spaced along the drill string between drill bit 40 and pipe joints 33.

In the embodiment depicted, drill bit 40 is rotated by rotation of drill string 30 from the surface. In particular, drill string 30 is rotated by a rotary table 22 that engages a kelly 23 coupled to uphole end 30*a* of drill string 30. Kelly 23, and hence drill string 30, is suspended from a hook 24 attached to a traveling block (not shown) with a rotary swivel 25 which permits rotation of drill string 30 relative to derrick 21. Although in this embodiment drill bit 40 is rotated from the surface with drill string 30, in general, the drill bit 40 can be rotated with a rotary table or a top drive, rotated by a downhole mud motor disposed in a bottom hole assembly (BHA) disposed in the drill string above the bit, or by combinations thereof (e.g., rotated by both rotary table via the drill string and the mud motor, rotated by a top drive and the mud motor, etc.). Thus, it is to be appreciated that the various aspects disclosed herein are adapted for employment in each of these drilling configurations and are not limited to the particular method employed to rotate the drill bit 40 or drill string 30.

During drilling operations, a mud pump 26 at the surface draws cleaned drilling fluid or mud from mud tanks 27 and pumps the drilling fluid down the interior of drill string 30 via a port in swivel 25. The drilling fluid exits drill string 30 through ports or nozzles in the face of drill bit 40 and through other nozzles that described in more detail below. The drilling fluid then circulates back to the surface through the annulus 13 that exists between drill string 30 and the sidewall of borehole 11. In addition to carrying drilled cuttings to the surface, the drilling fluid functions to maintain pressure in the well, as well has to lubricate and cool drill bit 40.

Drilling Tool

Figure 2:
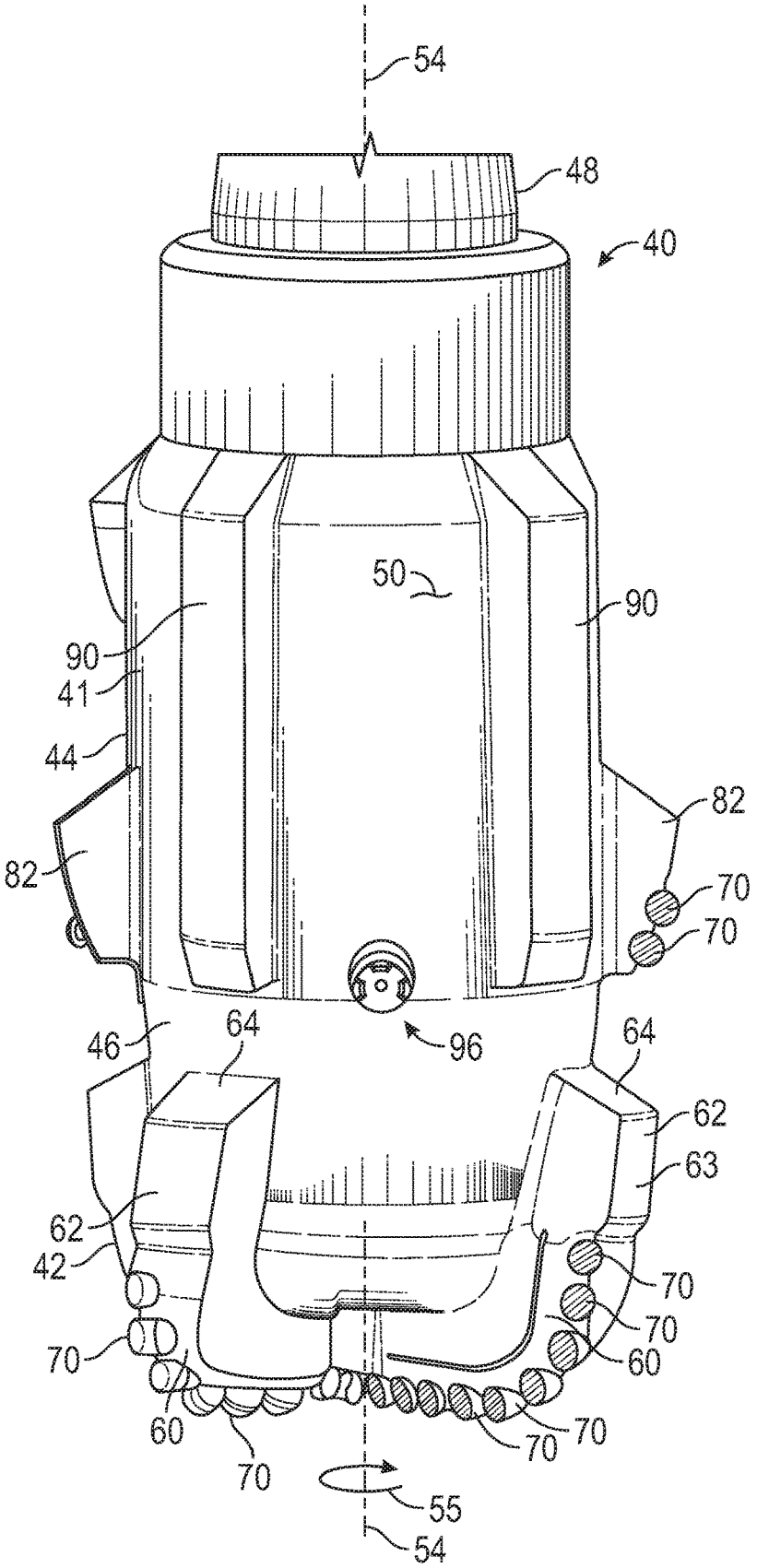
FIG. 2 is a front elevation view of the drilling tool shown in FIG. 1.
Figure 3:
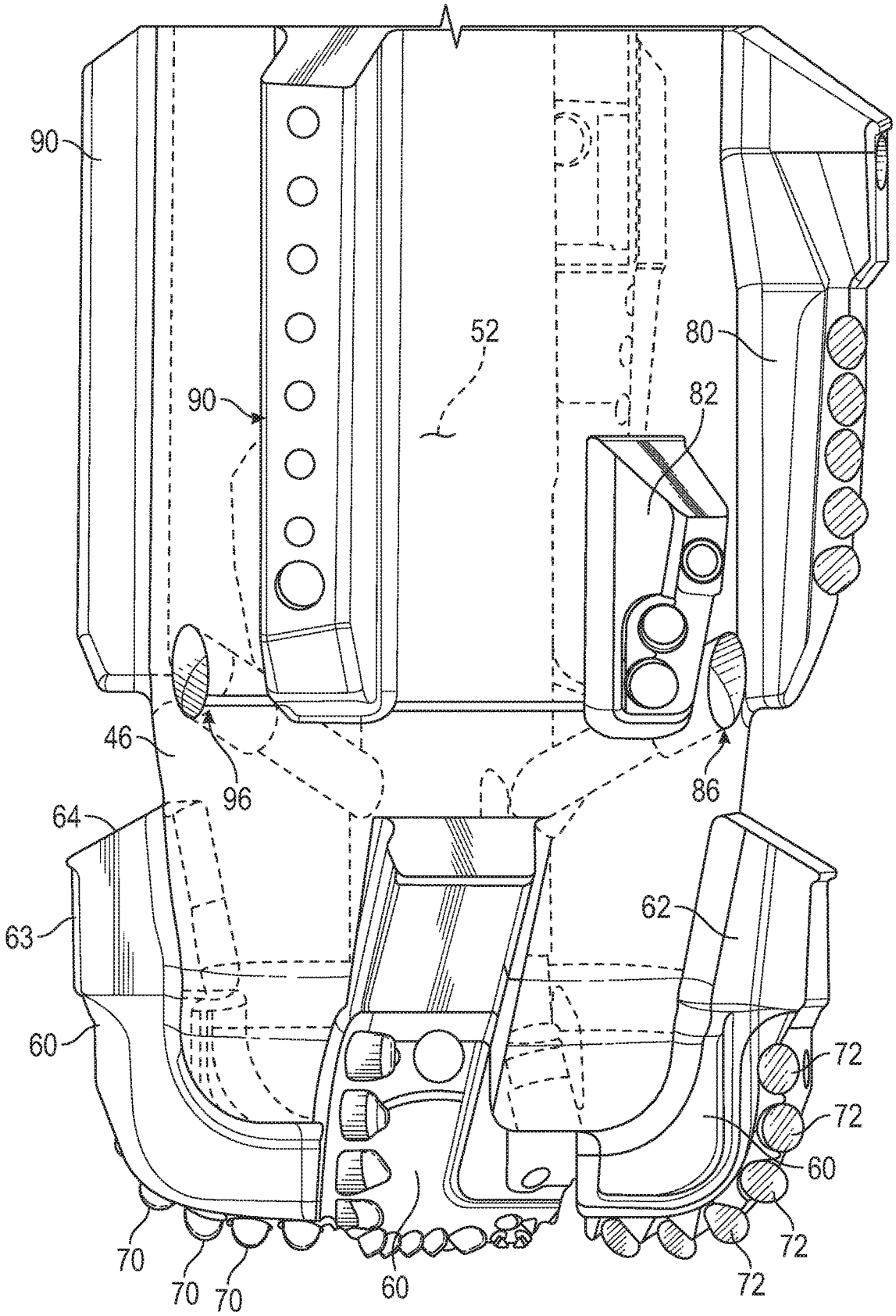
FIG. 3 is an enlarged, elevation view of the tool of FIG. 1, rotated slightly from the elevation view shown in FIG. 2.

Referring now to FIGS. 2 and 3, bi-center drill bit 40 includes an elongate and tubular tool body 41, a pilot bit portion 42, a reamer portion 44 spaced axially above the pilot portion, and a neck portion 46 therebetween. Bit 40 further includes a threaded pin 48 at the uppermost end of tool body 41 and that is threaded into a box end of the lowermost pipe joint 33, or into the box end of another component of the drill sting 30, such as a BHA (not shown). Tubular body 41 includes a generally cylindrical outer surface 50 and an inner through bore 52 (FIG. 3). Bore 52 allows for the conveying drilling fluid from drill string 30 to the nozzles that are positioned in bit 40 as will be explained in further detail below. Bit 40 includes a rotational axis 54 that is central to pilot bit portion 42 and to pin 48 and that is coaxial with drill string axis 31 when pin 48 is threadedly connected to drill string 30. During drilling operations, bit 40 is rotated about axis 54 in a cutting direction 55 shown in FIG. 2. In this embodiment, the entire drilling tool 40 is milled from a single steel member, such that pilot bit 42, reamer 44, neck 46 and pin 48 constitute a unitary or monolithic structure. In other embodiments, all or portions of the drilling tool 40 may be made from a matrix material or drilling tool 40 may be a combination of steel and matrix materials.

Pilot Hole Portion.

Figure 4:
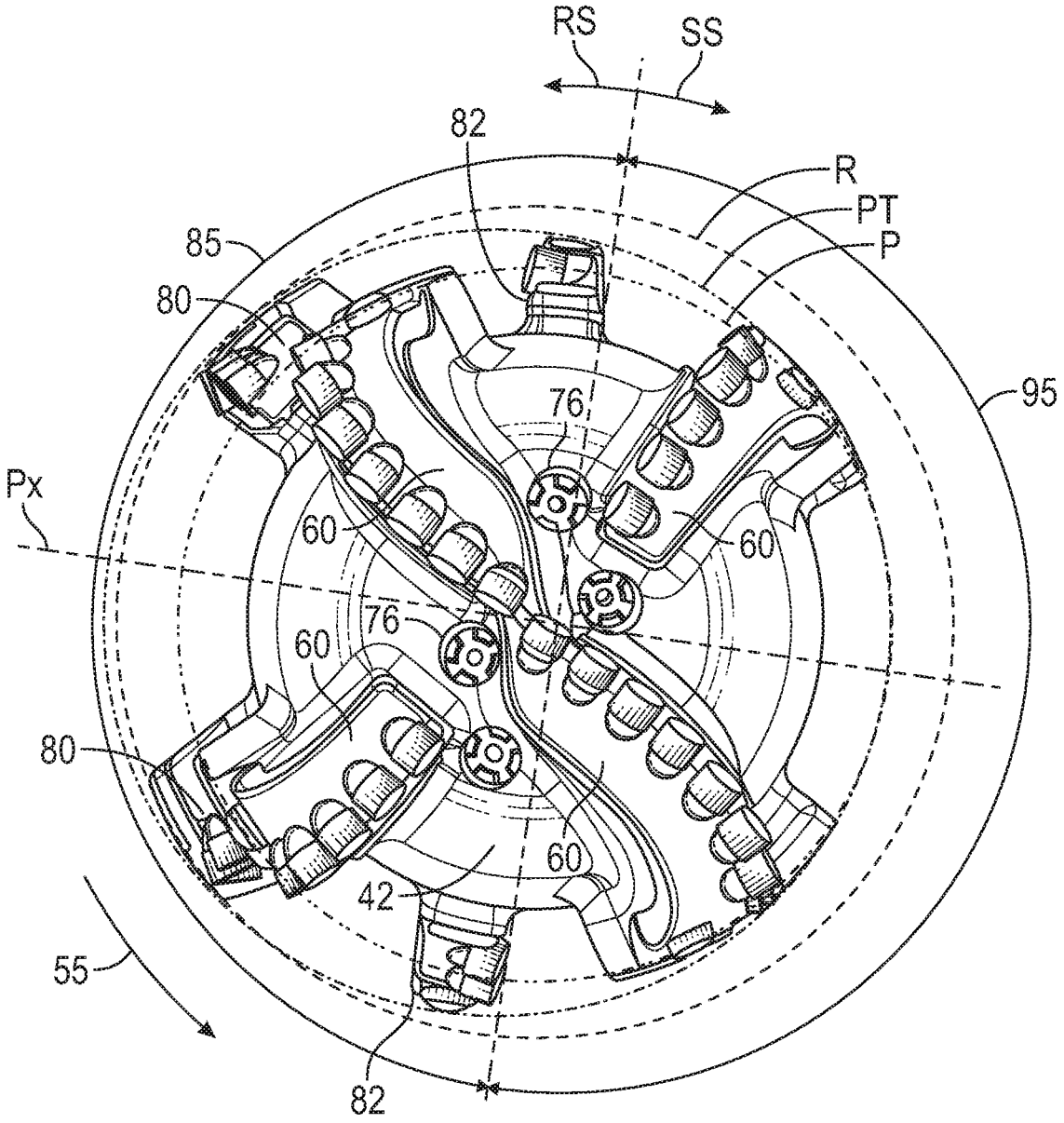
FIG. 4 is bottom view of the drilling tool of FIG. 2, as viewed looking up hole.

Referring to FIGS. 2-4, in this exemplary embodiment, pilot bit portion 42 is a fixed cutter bit having four blades 60 extending along the outside of tool body 41. A plurality of polycrystalline diamond (PCD) cutter elements 70 are disposed side-by-side along the forward facing surface 61 of each blade 60. Each cutter element 70 described herein can be any suitable type of cutter element known in the art. In this embodiment, each cutter element 70 comprises an elongate cylindrical tungsten carbide support member and a hard polycrystalline diamond (PCD) cutting layer bonded to the end of the support member. The support member of each cutter element 70 is received and secured in a pocket formed in the forward facing surface 61 of the corresponding blade 80, 82 with cutting face 72 exposed relative to the cutting direction of rotation 55. In this embodiment, cutting faces 72 are substantially planar, but may be convex or concave in other embodiments.

Figure 5:
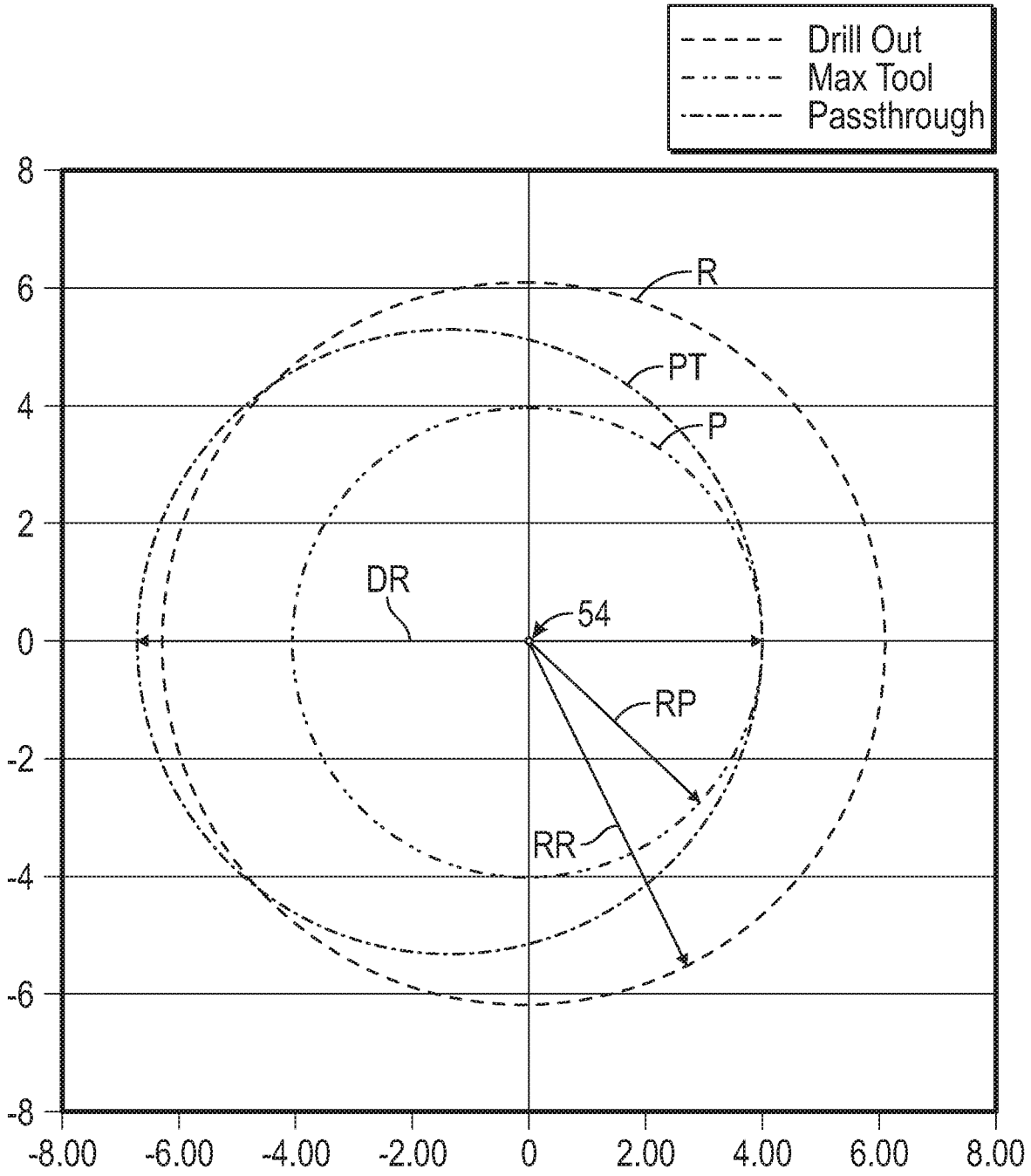
FIG. 5 is a schematic representation showing dimensions of various portions of the drilling tool of FIG. 2, including when the tool is rotated while drilling and when the tool is passing through the casing of the drilling system shown in FIG. 1.

Pilot bit portion 42 has a maximum or full gage diameter that is defined by the radially outermost reaches of blades 60 and their cutter elements 70. Referring momentarily to FIG. 5, the full gage diameter of pilot bit portion 42 is equal to 2 times RP, where RP is the radius measured from rotational axis 54 to the outmost reaches of cutter elements 70 on blades 60. As such, the hole cut by pilot bit portion 42, as viewed in a cross section taken perpendicular to rotational axis 54, is the circle P shown in FIGS. 4 and 5. A gage pad 62 is disposed on each blade 60 at a position that is uphole of the blade's row of cutter elements 70. Each gage pad 62 includes a radially outermost surface 63 that extends radially to full gage diameter, and further includes an upper surface 64 that, as best shown in FIG. 2, is slanted toward the axis 54 and away from outer surface 63. A plurality of pilot bit nozzles 76 are disposed in the face region of pilot bit portion 42 and are in fluid communication with through bore 52 and configured to jet drilling fluid from the bit face in order to prevent cuttings from aggregating on the cutter elements 70 and to then carry the drilled cuttings to the surface.

Reamer Portion.

Referring again to FIGS. 2-4, in the embodiment shown, reamer portion 44 includes a first plurality of reamer blades 80, 82 and a second plurality of stabilization blades or pads 90. Reamer blades 80, 82 and stabilization blades 90 all extend radially outward from the tool body 41 and are all spaced apart from one another. Blades 80, 82 and 90 are integrally formed as a part of body 41. In other words, blades 80, 82, 90 and body 41 are a unitary or monolithic structure. Reamer blades 80, 82 are provided to cut and shear the sidewall of borehole 11, thereby removing ledges and corners and enlarging the drilled borehole, while blades 90 provide added mass to counteract forces on blades 80, 82 and to balance and stabilize bit 40 while tripping.

In this embodiment, two long reamer blades 80 extend upward in the axial direction from neck 46 to a position below pin 48 and are generally parallel to one another. In other embodiments, the reamer blades 80 need not be parallel and may be configured in an angular or spiral arrangement. Two short reamer blades 82 extend in the axial direction from neck 46 and terminate at a position approximately ⅓ to ½ of the height of the long reamer blades 80. In this exemplary embodiment, long and short reamer blades 80, 82, respectively, extend outwardly from tool body 41 the same distance (i. e. same radius) as measured from rotational axis 54; however, they need not be equal length in all applications As best shown in FIG. 4, long reamer blades 80 are angularly spaced approximately 90° from one another and short reamer blades 82 are spaced approximately 45° apart from an adjacent long reamer blade 80 in this embodiment. As such, the reamer blades 80, 82 are contained in an arcuate segment 85 (FIG. 4) of bit 40 that extends approximately 180 to 200° of the circumference of the body 41. A plurality of PCD cutter elements 70 are disposed side-by-side along the leading edge of each stabilizer blade 80, 82 such that each cutting face 72 of cutter elements 70 is generally forward-facing relative to the cutting direction of rotation 55. Also in this embodiment, wear resisting inserts 74 are positioned in the radially outward facing face of long and short reamer blades 80, 82. A reamer-side nozzle 86 is positioned in front of each long reamer blade 80 (one visible in FIG. 3). The reamer-side nozzles 86 are positioned to help keep drilled solids from becoming compacted on blades 80 and their cutter elements 70, and to convey the drilling fluid in an upward direction. As shown in FIG. 3, reamer-side nozzle 86 is positioned in fluid communication with through bore 52 and is angled upward at approximately 50° relative to rotational axis 54. In other embodiments, the nozzles 86 are positioned at other angles, such as from 0° to 30° relative to axis 54.

Still referring to FIGS. 2-4, stabilization blades 90 are angularly spaced apart from one another by approximately 90° in this particular embodiment. The two stabilization blades 90 extend in the axial direction from neck portion 46 to a position below pin 48. In this exemplary embodiment, the length of stabilization blades 90 is equal to the length of the long reamer blades 80; however, the length of the stabilization blades 90 and long reamer blades 80 need not be the same in all applications. Stabilization blades 90 are free of forward-facing cutter element 70, however, wear resistant inserts 74 are positioned in the radially outwardly facing surface of blade 90. In this embodiment, and as best shown in FIG. 4, stabilization blades 90 are contained in an arcuate segment 95 of bit 40 that extends approximately 160° to 180° about the circumference of the body 41. More precisely, the arcuate segment 95 is equal to 360° minus the measure of arcuate segment 85 for the reamer blades.

In the exemplary embodiment described, stabilization blades extend from outer surface 50 of tool body 41 the same distance (i. e. same radius) as one another and as measured from rotational axis 54, however, they do not extend as far as reamer blades 80, 82. Given this arrangement, reamer portion 44 of bi-center bit 40 is an eccentric reamer, and when bit 40 is rotated about rotational axis 54, the hole cut by reamer portion 44, as viewed in a cross section taken perpendicular to rotational axis 54, is the circle R shown in FIGS. 4 and 5 that has the diameter equal to 2 times the radius RR shown in FIG. 5, where RR is the radius measured from rotational axis 54 to the outmost reaches of cutter elements 70 on reamer blades 80, 82. Circle R has a larger diameter as compared to the concentric circle P presented by pilot portion 42. As shown in FIG. 4, the line that separates the arcuate segment 85 containing reamer blades 80, 82 from arcuate segment 95 that contains stabilization blades 90 is used in the definitional sense to define the reaming side RS of the bit and the stabilizing side SS of the bit. Thus, the word "side" as used in the context of discussing a reaming side or a stabilizing side, does not imply or indicate that the particular "side" being discussed has an angular measurement equal to 180° of the tool's circumference.

Because the reamer portion 44 of the bi-center bit 40 is eccentric, it includes a maximum dimension DR (FIG. 5) as measured perpendicular to rotational axis 54. DR is greater than the diameter of circle P made by pilot portion 42 but less than the diameter of circle R made by reamer portion 44 when bi-center bit 40 is rotated. DR may be referred to as the pass through dimension or pass through diameter of bit 40, and is the diameter of the circle PT shown in FIGS. 4 and 5. Reamer portion 44 is dimensioned such that the pass through diameter DR is less than the diameter $D_{14}$ of casing 14 to enable bi-center bit 40 to be pushed through the casing 14. Thus DR, defining the circle PT, represents the minimum diameter casing 14 through which reamer portion 44 (and thus bit 40) can be tripped.

Stabilizer-Side Nozzle

Referring to FIGS. 2 and 3, at least one stabilizer-side nozzle 96 is positioned on the stabilizing side of bit 40. The stabilizer-side nozzle 96 is positioned so as to direct drilling fluid in an upward direction. As shown in FIG. 3, in this embodiment, stabilizer-side nozzle 96 is in fluid communication with through bore 52 and is angled upward. In the particular embodiment shown in FIGS. 2, 3, nozzle 96 is angled upward at approximately 50° relative to axis 54. In other embodiments, nozzle 96 will be angled upward between 0° and 90°, and in other embodiments, between 0° and 30°. Although, other factors play a role in the angle to which nozzle 96 is directed, it is generally the case that the smaller the angle the better the hydraulics.

In this particular embodiment, a single stabilizer-side nozzle 96 is positioned in the arcuate section 95, in between the two stabilizer blades 90. However, where in the stabilizing side of the bit the stabilizer-side nozzle 96 is placed is incidental to the number and placement of stabilizer blades 90. Instead, positioning of the stabilizer-side nozzles 96 is placed more with reference to the number and placement of reamer blades 80, 82. In the case of stabilizer-side nozzle 96 shown in the exemplary embodiment shown in FIG. 2, its circumferential position within arcuate segment 95 is determined by determining the location of the intersection between the plane PX (shown in FIG. 4) with outer surface 50 within arcuate segment 95. Plane PX is the plane that contains rotational axis 54 and that bisects the arcuate segment 85 that defines the reaming side of the bit. Stabilizer-side nozzle 96, in this embodiment, is positioned at the intersection of plane PX and outer surface 50 within arcuate segment 95. In other embodiments, it may be positioned, for example, within 90° of the intersection of plane PX and outer surface 50 within arcuate segment 95, and in other embodiments, within 45° of that intersection. In the axial dimension, and as best shown in FIGS. 2 and 3, stabilizer-side nozzle 96 is positioned below the lowermost cutter element 70 of the lowermost ends of reamer blades 80, 82. Further, in many embodiments, the stabilizer-side nozzle 96 is positioned axially above neck portion 46.

Figure 6:
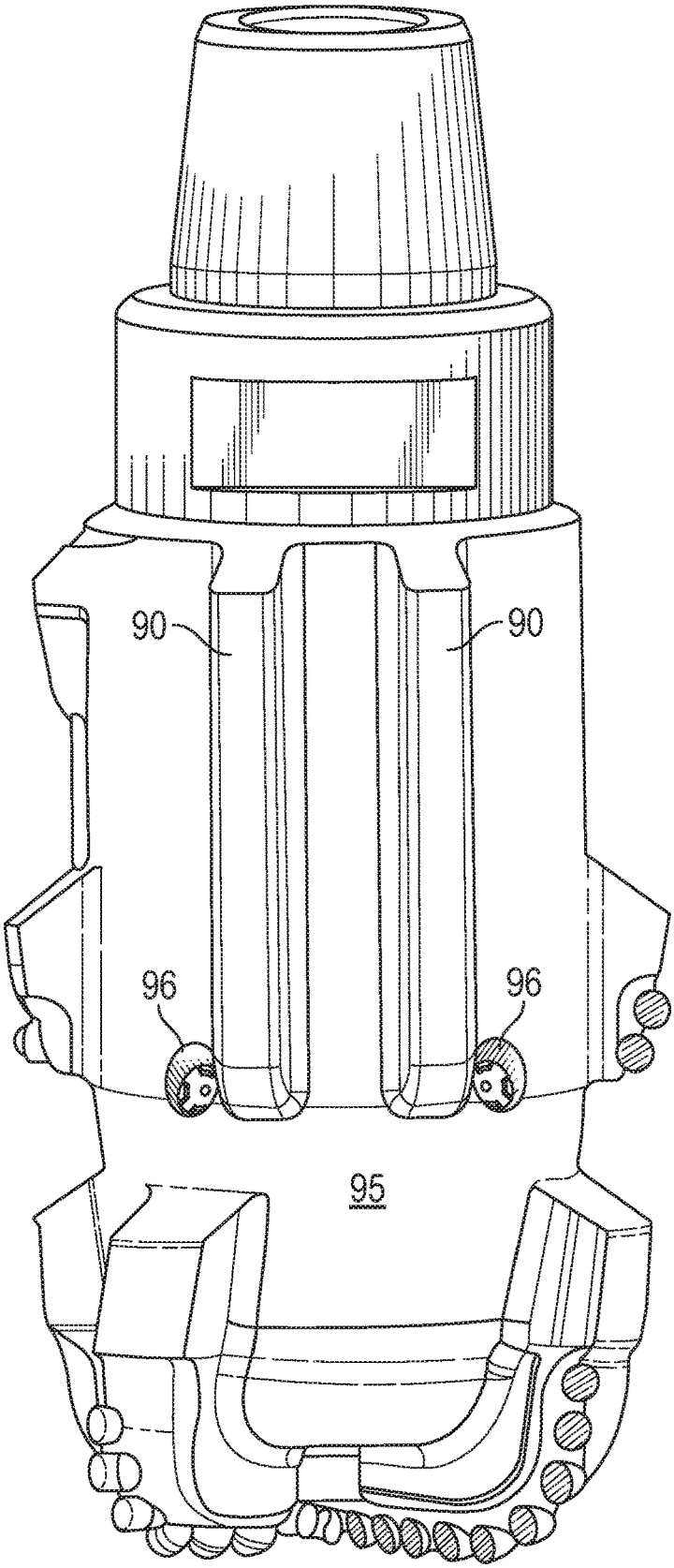
FIG. 6 is an elevation view of an alternative embodiment of the drilling tool shown in FIG. 1.
Figure 7:
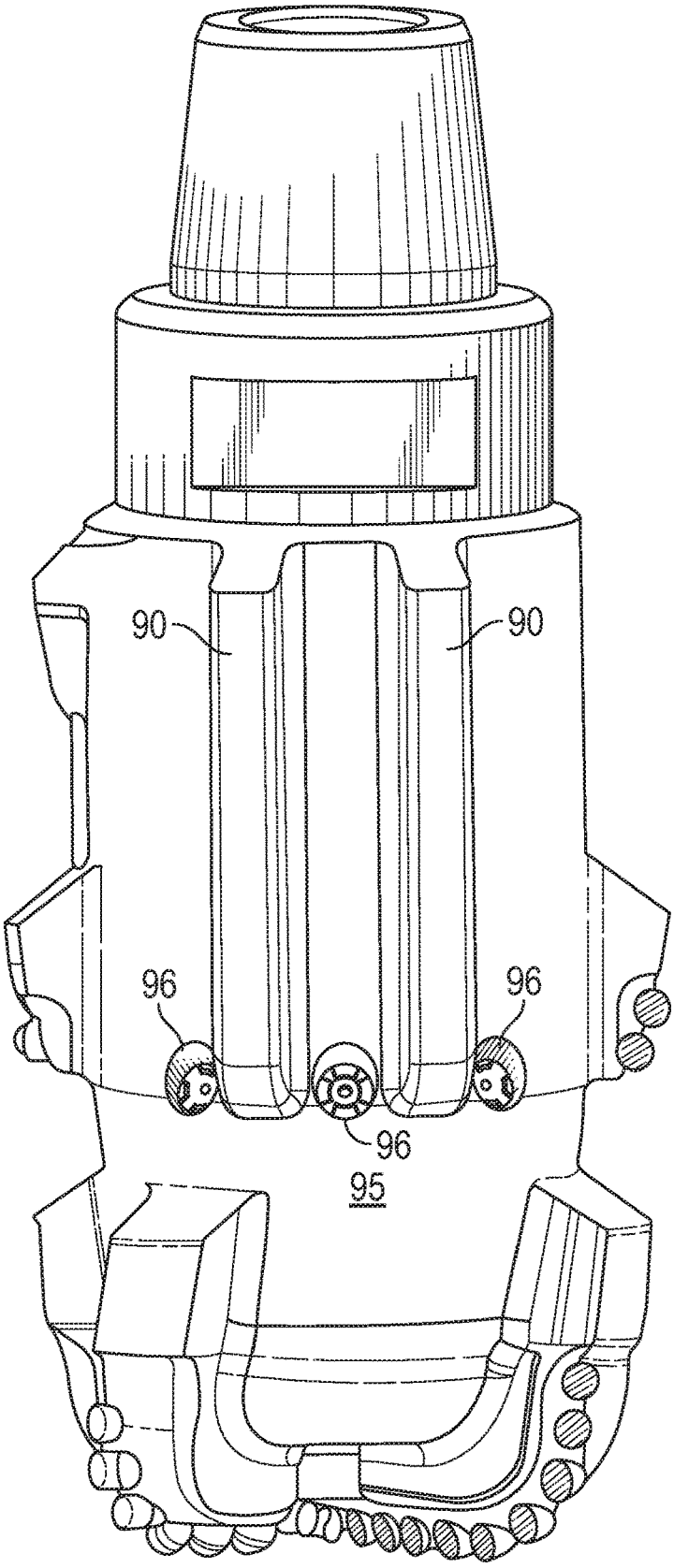
FIG. 7 is an elevation view of another alternative embodiment of the drilling tool shown in FIG. 1.

In some embodiments, more than a single stabilizer-side nozzle 96 may be employed. Referring now to FIG. 6, two stabilizer-side nozzles 96 are provided on the arcuate section 95 containing the stabilization blades 90. In this exemplary embodiment, nozzles 96 are circumferentially placed within arcuate segment 95 equidistant from intersection between the plane PX (shown in FIG. 4) with outer surface 50. In this embodiment, the two stabilizer-side nozzles 96 are positioned at the same axial location: positioned below the cutter elements 70 on reamer blades 80, 82 and above neck 46. In the embodiment shown in FIG. 7, three stabilizer-side nozzles 96 are positioned within arcuate segment 95. In this exemplary embodiment, the three nozzles 96 are positioned at the same axial position, with one being disposed at the intersection between the plane PX (FIG. 4) with outer surface 50, and the other two being equal distance from that point of intersection.

Even given that stabilizer-side nozzles 96 are not positioned to direct fluid flow on or across cutter elements or cutter-carrying blades, providing nozzles 96 in the stabilizing side of a reamer is believed to increase the speed of the upward flow of drilling fluid in the annulus 13. Further, providing one or more stabilizer-side nozzle 96 it is believed to reduce undesirable recirculation of fluid in the portion of the annulus 13 adjacent to the stabilization side, prevent back flow towards the pilot bit, and potentially decrease the chance of bit balling.

Nozzle Buttress

Figure 8:
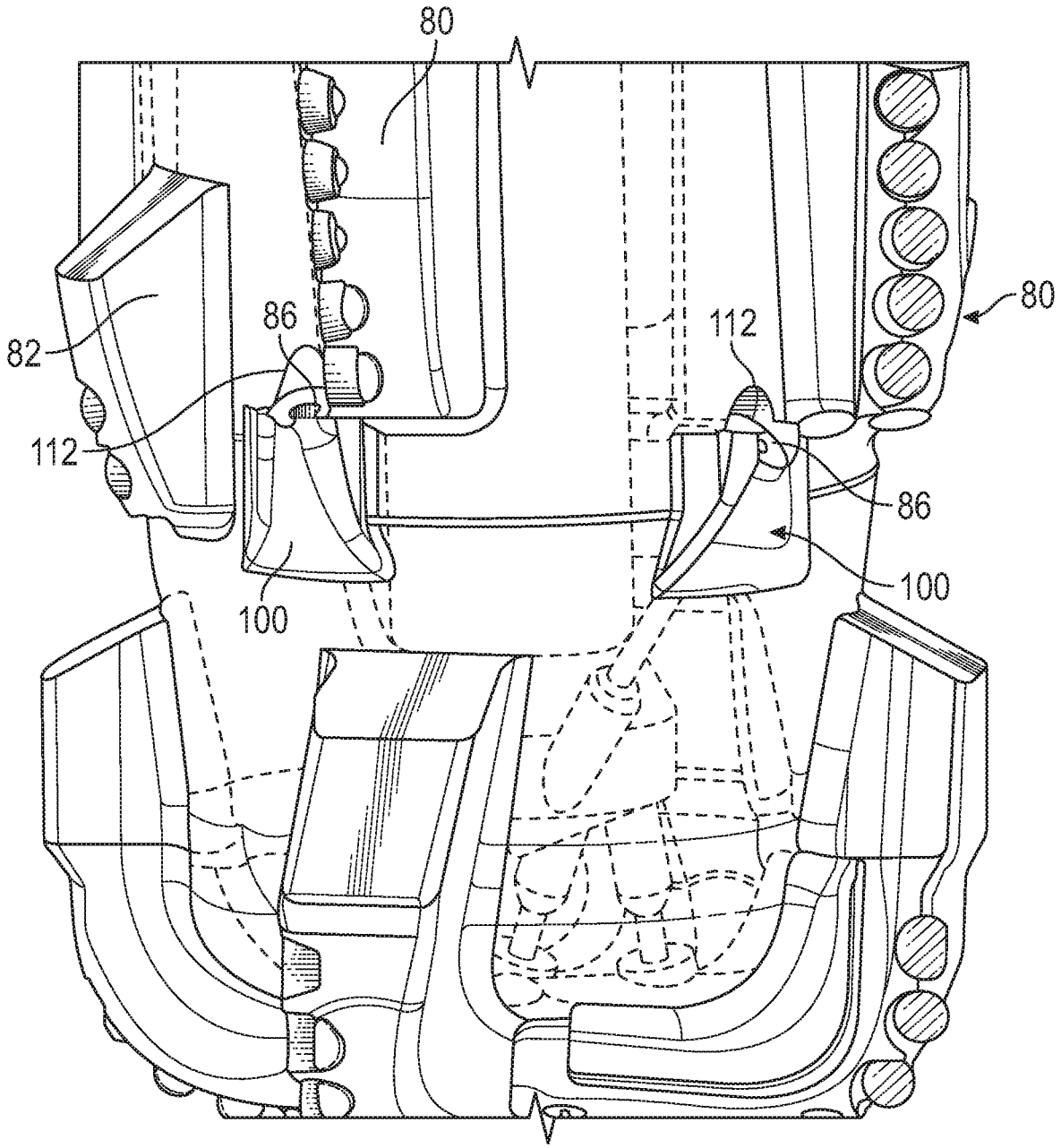
FIG. 8 is an elevation view of another alternative embodiment of the drilling tool of FIG. 1 and including built-up nozzle supports.
Figure 9:
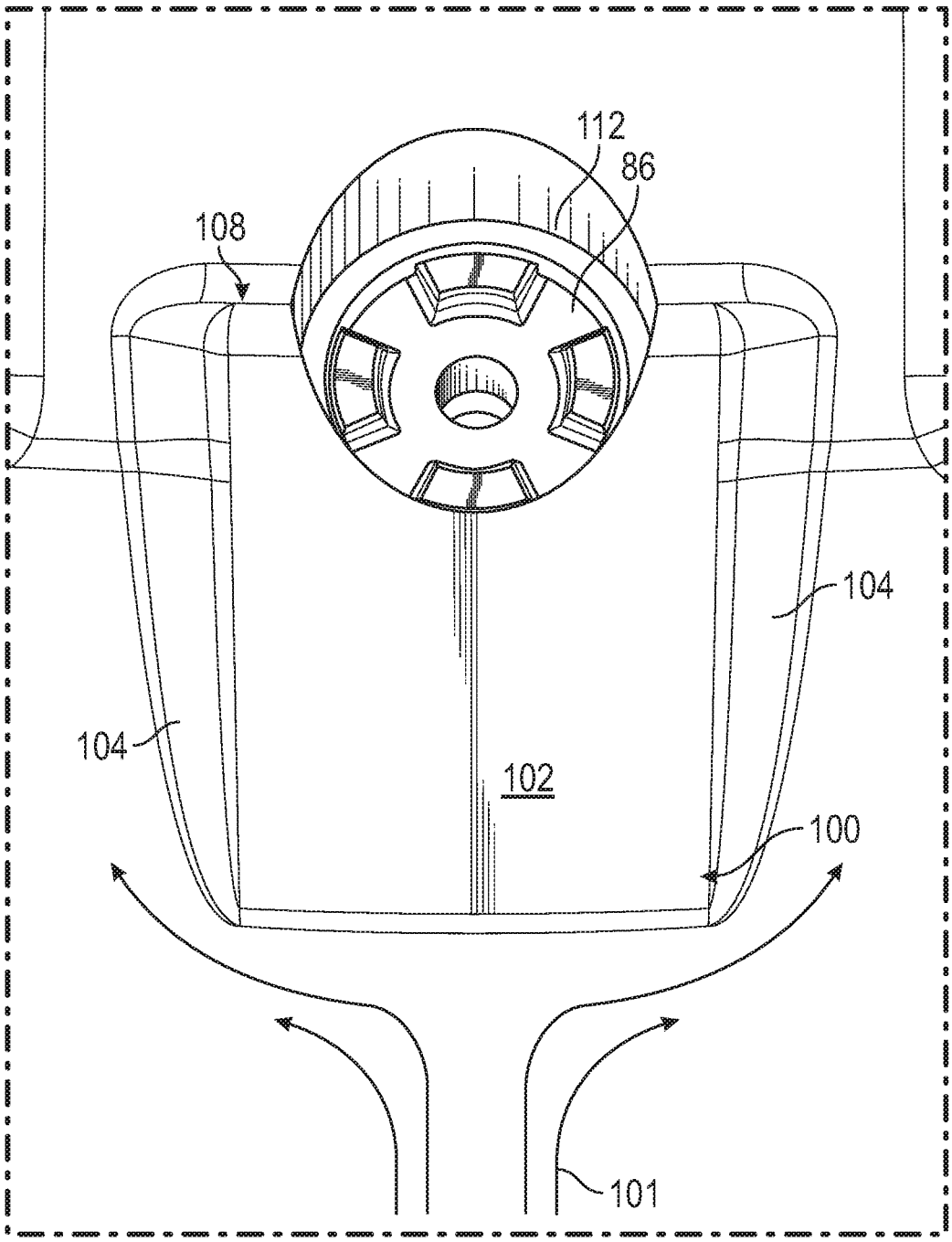
FIGS. 9 and 10 are enlarged views of built-up nozzle supports of FIG. 8.
Figure 10:
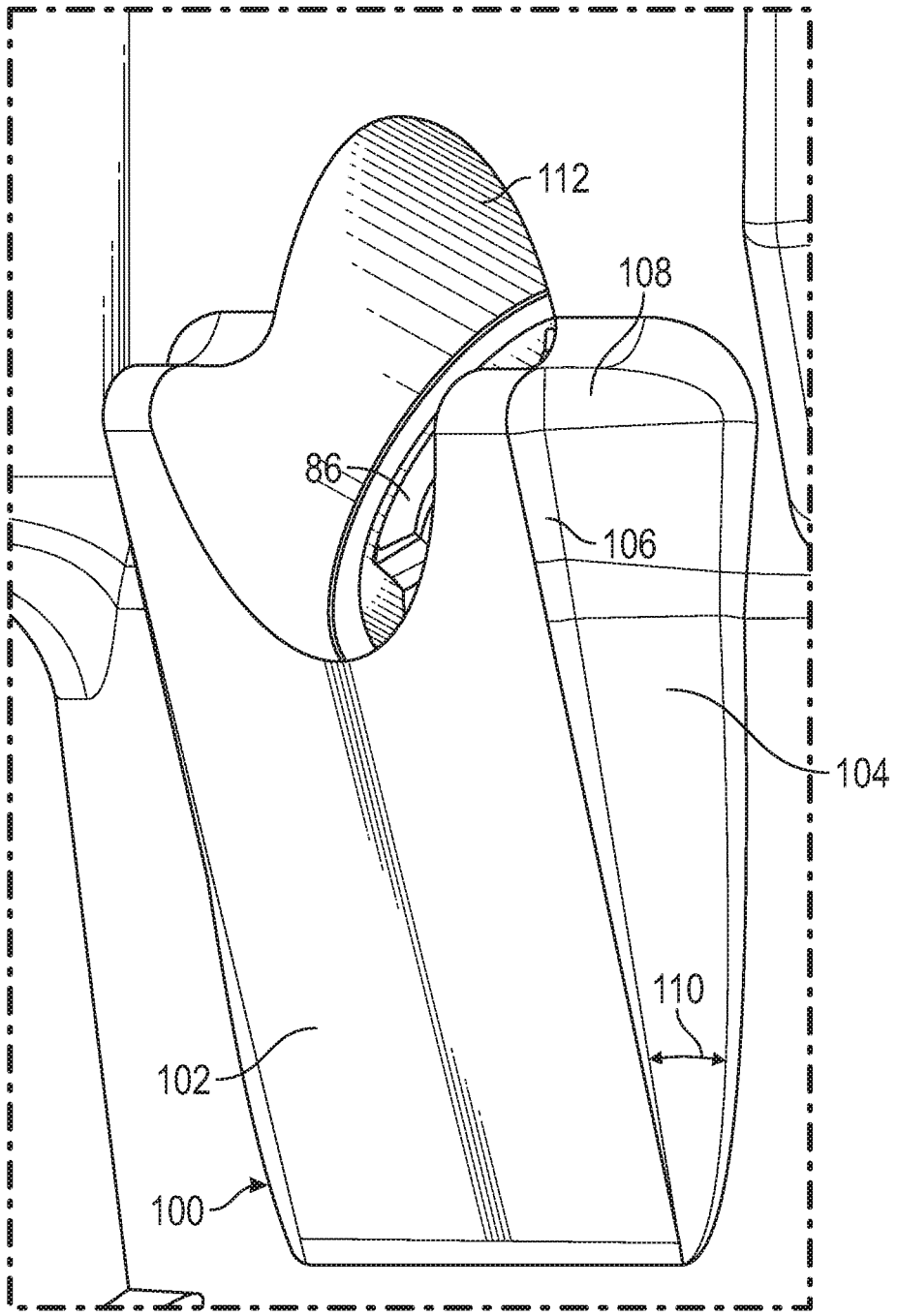

In some embodiments, bi-center bit 40 includes nozzle buttresses 100, best shown in FIGS. 8-10. Buttresses 100 are provided to provide extra support for nozzles 86, 96 and, more particularly, to provide the extra material required to have nozzles 86, 96 direct fluid upwardly at the desired, acute, flow angle. Further, the added material provided by buttresses 100 allows reaming side nozzles 86 to be positioned, in certain embodiments, directly in front of the reamer blades. Buttresses 100 may further be employed to help direct the flow of drilling fluid into a desired flow path 101 (FIG. 9) as the fluid flows uphole in the annulus 13 after being jetted from nozzles 76 in the face of pilot bit portion 42. In the embodiment shown, in which bi-center bit 40 is machined from steel, buttresses 100 are formed in the milling process from which pilot bit 42, neck 46 and reamer portion 44 are formed. In other embodiments, such as when the drilling tool having nozzles being buttressed is made of matrix material, buttress 100 may be formed in the same matrix process from which the body is formed.

In more detail, buttress 100 extends from the body 41 and spans an axially extending region that includes portions of reamer portion 44 and neck portion 46. In the embodiment shown, buttress 100 includes a generally gage-facing ramped surface 102 and side surfaces 104 that meet at intersections 106. Ramped surface 102 extends upwardly away from outer surface 50 of the tool body 41 at what is referred to herein as a ramp angle 110, terminating at top surface 108. In the embodiment shown, top surface 108 extends generally perpendicularly to bit axis 54; however surface 108 may be angled differently so as to present a ramped surface that extends downwardly from surface 50 to the intersection with surface 102. Dimensional requirements compete with the designed goal of providing additional structural material needed to support the nozzle and allow it to be upwardly-directed as desired. In particular, ramp angle 110 and the length of ramped surface 102 are selected such that the buttress 100 does not extend radially so far as to prevent the bi-center bit 40 from passing through the pass through circle PT described above with respect to FIGS. 4 and 5. Sides 104 slope from ramped surface 102 to surface 50 at an angle that is greater than 90°. In the embodiment shown, the width of ramped surface 102 is generally constant, although in other embodiments, it may be wider at the top or the bottom in order to direct the upwardly moving fluid flow in a desired direction.

A nozzle bore 112 is formed through the upper end of buttress 100 and into reamer body portion 44 and is in fluid communication with internal fluid passageway 52. A nozzle, such as a reaming side nozzle 86 is fixed in bore 112. In this embodiment, buttress 100 is aligned with the centerline of nozzle 86 such that buttress 100 extends laterally equal distance on either side of nozzle bore 112. As shown in FIG. 8, nozzle 86 is positioned in bore 112 for directing fluid flow in the fluid direction 101 as previously described above. Although buttress 100 is shown in FIGS. 8-10 as providing support for reaming side nozzles 86, buttresses 100 may likewise be employed to support stabilizing side nozzles 96, or any other nozzle in the drilling tool.

Neck Ramp

Figure 11:
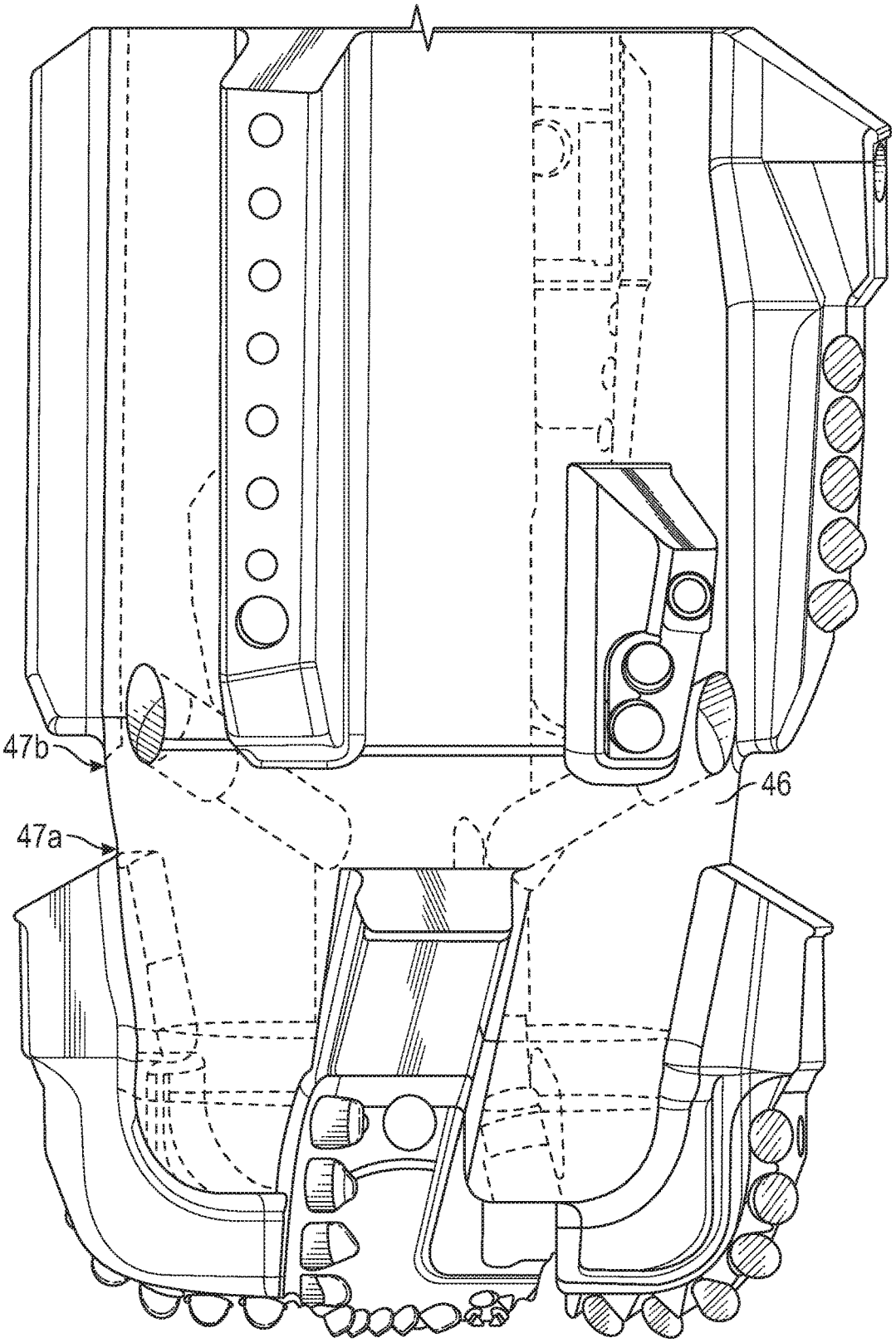
FIG. 11 is an enlarged, elevation view of a portion of the drilling tool shown in FIG. 1, including the neck portion.

Referring to FIG. 11, the outer surface of neck portion 46 is formed to be frustoconical. More particularly, the outer surface 50 of the tool body 41 in the neck portion 46 tapers from a first diameter at an axial position 47*a* (adjacent the pilot bit 42) to a second diameter at an axial position 47*b* (adjacent the reamer portion 44), wherein the second diameter is greater than the first diameter. This tapered profile provided by the frustoconical surface provides for more effective evacuation of drilled solids and for enhanced fluid velocity. That is, the described neck configuration can have the effect of enhancing the speed with which the cutting-laden drilling fluid moves past the gage surfaces of the pilot bit 42 and of decreasing the chance of accumulating cuttings in known lower-speed areas, such as those adjacent to neck portion 46.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention that is set out in the claims below. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order.

What is claimed is:

1. A drilling tool comprising:

a pilot bit coupled to an eccentric reamer, wherein the reamer comprises a reaming side and a stabilizing side;

a fluid passageway extending between the reamer and the pilot bit;

at least a first upwardly-directed nozzle in fluid communication with the fluid passageway and positioned on the stabilizing side of the reamer;

a body having a central longitudinal axis, the fluid passageway extending through the body;

wherein the pilot bit is positioned at a first end of the body and includes a rotational axis aligned with the central axis of the body and the reamer is coupled to the body at a position axially spaced apart from the pilot bit, the reamer comprising:

an outer surface;

a plurality of reamer blades on the reaming side that are angularly spaced apart and extend away from the outer surface a first distance measured radially from the central axis, the reamer blades being disposed within a first arcuate segment that is defined by the two most distant reamer blades of the plurality;

one or more stabilization blades on the stabilizing side extending away from the outer surface a second distance measured radially from the central axis wherein the second distance is less than the first distance, the one or more stabilization blades being disposed within a second arcuate segment that is defined by the two most distant reamer blades of the plurality and that has the angular measure equal to 360 degrees minus the first arcuate segment, a portion of the second arcuate segment being free of stabilization blades;

wherein the first nozzle is disposed in the portion of the second arcuate segment that is free of stabilization blades at a position within a 90 degree arc on either side of the intersection of the outer surface of the reamer with a plane that bisects the first arcuate segment and that contains the central axis, the first nozzle being configured to direct fluid that is conveyed to the first nozzle from the fluid passageway away from the pilot bit and in a direction that forms an acute angle as measured with respect to the central axis.

2. The drilling tool of claim 1 wherein the first nozzle is disposed at a position along the intersection of the outer surface of the reamer with a plane that bisects the first arcuate segment and that contains the central axis.

3. The drilling tool of claim 1 further comprising a neck portion between the pilot bit and the reamer, and wherein at least one of the plurality of reamer blades includes a plurality of cutter elements, and wherein the first nozzle is disposed at an axial position that is between the neck portion and the cutter element of the plurality that is closest to the pilot bit.

4. The drilling tool of claim 1 wherein the acute angle is 45 degrees or less.

5. The drilling tool of claim 1 further comprising:

a second nozzle disposed in the second arcuate segment and configured to direct fluid that is conveyed to the second nozzle from the fluid passageway away from the pilot bit and in a direction that forms an angle that is less than 90 degrees as measured with respect to the central axis; and wherein the first and the second nozzles are equally spaced on either side of the intersection between the outer surface of the reamer and a plane that bisects the first arcuate segment and that contains the central axis.

6. The drilling tool of claim 1 further comprising a buttress on the reamer, wherein the first nozzle extends through the buttress.

7. The drilling tool of claim 1, wherein the first nozzle is disposed at an acute angle that is 30 degrees or less as measured with respect to the central axis.

8. The drilling tool of claim 1 further comprising a neck portion extending between the pilot bit and the reamer, wherein the neck portion includes a frustoconical outer surface that tapers from a first diameter adjacent the pilot bit to a second diameter adjacent the reamer, wherein the second diameter is greater than the first diameter.

9. The drilling tool of claim 1, wherein the one or more stabilization blades axially overlap at least a portion of the first nozzle along the central longitudinal axis.

10. The drilling tool of claim 1, wherein the plurality of reamer blades axially overlap the one or more stabilization blades along the central longitudinal axis.

11. A drilling tool comprising:

a pilot bit coupled to an eccentric reamer, wherein the reamer comprises a reaming side and a stabilizing side;

a fluid passageway extending between the reamer and the pilot bit;

at least a first upwardly-directed nozzle in fluid communication with the fluid passageway and positioned on the stabilizing side of the reamer;

a buttress on the reamer, wherein the first nozzle extends through the buttress; and wherein the buttress includes a ramp surface that extends away from the body of the tool at a ramp angle and that is configured to direct in a predetermined direction the fluid flow emanating from the pilot bit.

12. A drilling tool comprising:

a pilot bit concentric to a central axis and coupled to an eccentric reamer, the reamer including a reaming side with reamer blades and a stabilizing side with at least one stabilizer blade;

a fluid passageway extending through the eccentric reamer;

at least one nozzle positioned on the stabilizing side of the reamer and configured to direct fluid that is conveyed to the nozzle from the fluid passageway away from the pilot bit and in a direction that forms an acute angle as measured with respect to the central axis;

a buttress on the reamer configured to increase the wall thickness of the reamer at the position of the nozzle; and wherein the buttress includes a ramp surface that extends away from the body of the tool at a ramp angle and that is configured to direct in a predetermined direction the fluid flow emanating from the pilot bit.

13. A drilling tool comprising:

a pilot bit concentric to a central axis and coupled to an eccentric reamer, the reamer including a reaming side with reamer blades and a stabilizing side with at least one stabilizer blade;

a fluid passageway extending through the eccentric reamer;

at least one nozzle in the reamer configured to direct fluid that is conveyed to the nozzle from the fluid passageway away from the pilot bit and in a direction that forms an acute angle as measured with respect to the central axis;

a buttress on the reamer configured to increase the wall thickness of the reamer at the position of the nozzle;

wherein the reamer comprises:

an outer surface;

a plurality of reamer blades on the reaming side that are angularly spaced apart and extend away from the outer surface a first radial distance, the reamer blades being disposed within a first arcuate segment that is defined by the two most distant reamer blades of the plurality;

one or more stabilization blades on the stabilizing side extending away from the outer surface a second radial distance, wherein the second distance is less than the first distance, the one or more stabilization blades being disposed within a second arcuate segment that is defined by the two most distant reamer blades of the plurality and that has the angular measure equal to 360 degrees minus the first arcuate segment; and wherein the at least one nozzle is disposed in the second arcuate segment.

14. The drilling tool of claim 13 wherein the nozzle is disposed at a position along the intersection of the outer surface of the reamer with a plane that bisects the first arcuate segment and that contains the central axis.

15. The drilling tool of claim 13 wherein the at least one nozzle is disposed at an axial position that is above the neck portion.

16. The drilling tool of claim 13 wherein the at least one nozzle comprises a first and a second nozzle, the first and second nozzles being equally spaced on either side of the intersection between the outer surface of the reamer and a plane that bisects the first arcuate segment and that contains the central axis.

17. A drilling tool comprising:

a pilot bit concentric to a central axis and coupled to an eccentric reamer, the reamer including a reaming side and a stabilizing side;

wherein the reamer comprises a plurality of reamer blades on the reaming side that are angularly spaced apart, the reamer blades being disposed within a first arcuate segment that is defined by the two most distant reamer blades of the plurality;

wherein the reamer comprises at least one stabilizer blade on the stabilizing side that is disposed within a second arcuate segment defined by the two most distant reamer blades of the plurality and that has the angular measure equal to 360 degrees minus the first arcuate segment, a portion of the second arcuate segment being free of stabilizer blades;

a pin end axially spaced from the pilot bit;

a neck portion between the pilot bit and the eccentric reamer, wherein the neck portion includes a frustoconical outer surface that tapers from a first diameter adjacent the pilot bit to a second diameter adjacent the reamer, wherein the second diameter is greater than the first diameter;

wherein the reamer blades and the at least one stabilizer blade each have a first blade end that is adjacent to the neck portion at the second diameter; and wherein each of the reamer blades and the stabilizer blade extend axially from the first blade end toward the pin end;

a fluid passageway extending through the eccentric reamer and the neck portion;

at least one nozzle positioned in the portion of the second arcuate segment that is free of stabilizer blades, the nozzle being configured to direct fluid that is conveyed to the nozzle from the fluid passageway away from the pilot bit and in a direction that forms an acute angle as measured with respect to the central axis.

18. The drilling tool of claim 17 wherein the reamer comprises:

an outer surface; and wherein the at least one nozzle is disposed in the second arcuate segment at a position along the intersection of the outer surface of the reamer with a plane that bisects the first arcuate segment and that contains the central axis.

19. The drilling tool of claim 17 wherein the reamer comprises:

an outer surface;

and wherein the at least one nozzle comprises a first and a second nozzle, the first and second nozzles being equally spaced on either side of the intersection between the outer surface of the reamer and a plane that bisects the first arcuate segment and that contains the central axis each of the first and second nozzle being located in a portion of the second arcuate segment that is free of stabilizer blades.

20. The drilling tool of claim 17 wherein the at least one nozzle is disposed at an axial position that is above the neck portion.

21. The drilling tool of claim 17 further comprising a buttress on the reamer, wherein the at least one nozzle extends through the buttress, the buttress including a ramp surface that extends away from the body of the tool at a ramp angle that is configured to direct in a predetermined direction the fluid flow emanating from the pilot bit.

22. The drilling tool of claim 17, wherein the at least one stabilizer blade axially overlaps at least a portion of the nozzle along the central axis.

23. The drilling tool of claim 17, wherein the plurality of reamer blades axially overlap the at least one stabilizer blade along the central axis.

* * * * *